US005463953A

United States Patent [19]

Kaspers et al.

[11] Patent Number: 5,463,953

[45] Date of Patent: Nov. 7, 1995

[54] METHOD FOR PRINTING CARDS HAVING BLIND HOLE-SHAPED RECESSES AND AN APPARATUS FOR CARRYING OUT THE METHOD

[75] Inventors: Norbert Kaspers, Kemnat am Buchberg; Karl-Heinz Lang, Nittenau; Helmut Baader, Nabburg; Herbert Grün, Vaterstetten; Thomas Otto, Munich, all of Germany

[73] Assignee: GAO Gesellschaft fur Automation und Organisation mbH, Munich, Germany

[21] Appl. No.: 222,816

[22] Filed: Apr. 5, 1994

Related U.S. Application Data

[63] Continuation of Ser. No. 992,938, Dec. 18, 1992, abandoned.

[30] Foreign Application Priority Data

Dec. 20, 1991 [DE] Germany ..... 41 42 409.3

[51] Int. Cl.[6] ..... B41F 13/24

[52] U.S. Cl. ..... 101/485; 101/35; 101/41; 101/375

[58] Field of Search ..... 101/485, 493, 101/3.1, 4–5, 17, 22, 32, 35, 36, 37, 41, 42, 44, 93.41, 93.42, 292, 293, 294, 295, 316, 322, 375, 326, 407.1, 475; 29/827

[56] References Cited

U.S. PATENT DOCUMENTS

| | | | |
|---|---|---|---|
| 1,807,921 | 6/1931 | Lang et al. | 101/375 |
| 1,946,483 | 2/1934 | Casto et al. | 101/35 |
| 2,033,162 | 3/1936 | Von Webern | 101/35 |
| 2,069,789 | 2/1937 | Von Webern et al. | 101/36 |
| 2,585,410 | 2/1952 | Schott | 101/375 |
| 3,626,846 | 12/1971 | Wiegert et al. | 61/DIG. 30 |
| 4,460,825 | 7/1984 | Haghiri-Tehran et al. | 29/827 |
| 4,682,540 | 7/1987 | Eastman et al. | 101/32 |
| 4,737,620 | 4/1988 | Mollet et al. . | |
| 5,134,773 | 8/1992 | Lemaire et al. | 29/827 |

FOREIGN PATENT DOCUMENTS 2622323 4/1989 France .

*Primary Examiner*—Eugene H. Eickholt
*Attorney, Agent, or Firm*—Lowe, Price, LeBlanc & Becker

[57] ABSTRACT

A method for printing identity cards having blind hole-shaped recesses involves filling the recess at least partly with an element at the moment of printing so that the bottom of the recess is pressed against the printing surface. The elements are either firmly mounted on the back pressure surface of the apparatus or movably mounted in this surface. In the second case the elements can disappear into the back pressure surface if necessary.

14 Claims, 3 Drawing Sheets

Figure 2:
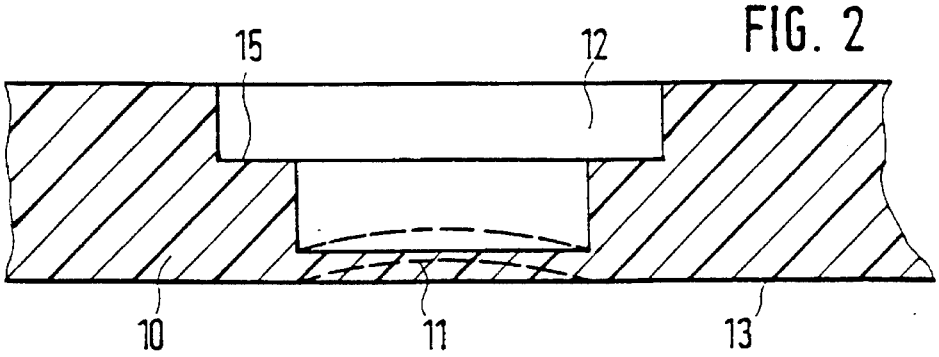

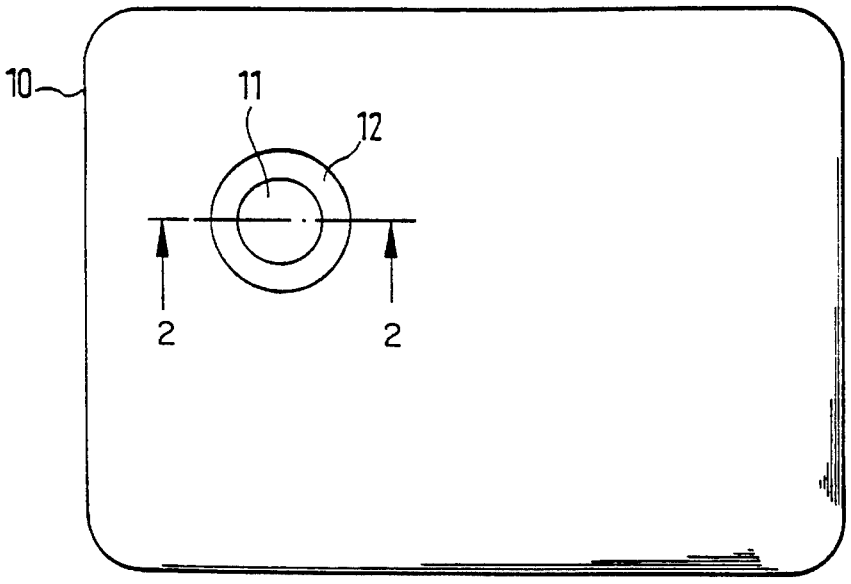
FIG. 1
FIG. 8
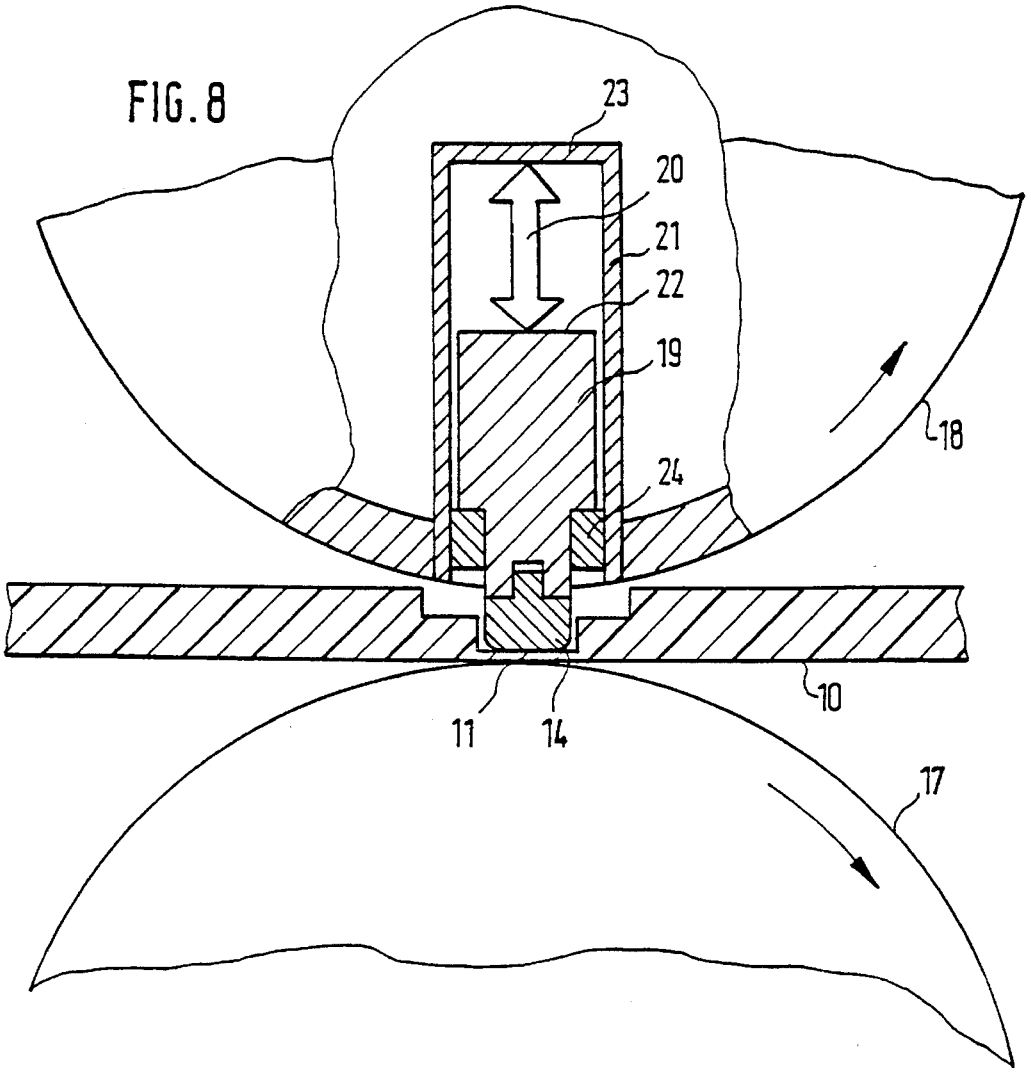

METHOD FOR PRINTING CARDS HAVING BLIND HOLE-SHAPED RECESSES AND AN APPARATUS FOR CARRYING OUT THE METHOD

This application is a continuation of now abandoned U.S. Ser. No. 07/992,938, filed Dec. 18, 1992.

The present invention relates to a method for printing identity cards having blind hole-shaped recesses.

Such identity cards are known for example from EP 0 197 47. The cards described therein comprise a one-layer card body containing a multistep recess for taking up a chip module.

In addition, FR 2 622 323 discloses injection molded cards with blind hole-shaped recesses for later taking up chip modules that are separated out of a plastic plate. The plastic plate is produced in a multicopy casting mold. Before the individual cards are separated out the plastic plate can be printed for example in multicolor print.

In both EP-B10 197 847 and FR-A12 622 323 the maximum depth of the recess differs little from the thickness of the identity card or the plastic plate, so that only a thin layer of about 100 micrometers remains in the area of the maximum depth of the recess. This layer will be referred to in the following as the membrane.

The existence of such sensitive membranes complicates the production of high-quality all-over printed patterns in the area of these membranes. During printing at least the membrane can give way to the pressure of the printing apparatus. This giving way of the membrane leads to distortion or interruption of the printed pattern in the area of the recess.

With a multistep recess as known from EP-B10 197 847 an area going beyond the membrane might give way as well. Furthermore, in the finished unprinted identity card or plastic plate the membrane can also be concavely deformed at worst. Due to this concave deformation the membrane does not lie in the card plane to be printed so that a continuous printing of the card plane is likewise impossible.

Finally the sensitive membrane and thus the identity card might be damaged during the printing operation. Pressure is exerted on the membrane during printing. If this pressure is not compensated by a counterpressure the membrane can tear.

Due to these difficulties the card plane opposite the recess is often not printed at least in the area of the membrane. This impairs the appearance of the identity card.

The invention is thus based on the problem of providing a method which makes it possible to produce a correct printed pattern in the area of the membrane and to protect the identity card optimally from damage at least in this area. The inventive solution to this problem and and advantageous embodiments of this solution can be found in the claims.

The basic idea of the invention is to provide on the back pressure roll an element adapted to The blind hole-shaped recess which at least partly fills the blind hole-shaped recess at the moment of printing, pressing the membrane against the print roll.

The advantages obtained with the invention are in particular that introducing the element adapted to the recess during the printing operation eliminates uneven areas in the identity card, giving rise to an ideal surface. This permits the identity card to be printed with a finely structured pattern even if the fine structures extend across the bottom area of the blind hole-shaped recess. One can thus apply high-quality printed patterns of any desired complexity to the surface of the identity card opposite the blind hole-shaped recess. Furthermore, damage to the identity card in the area of the membrane is almost excluded since the forces acting on the membrane are compensated at the moment of printing. Thus no resultant force acts on the membrane at any time.

Figure 3:
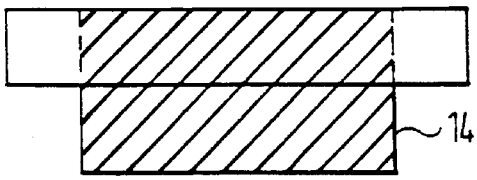
Figure 4:
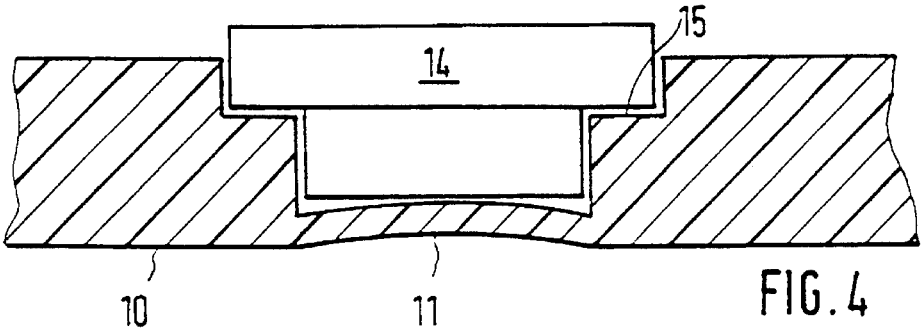
Figure 5:
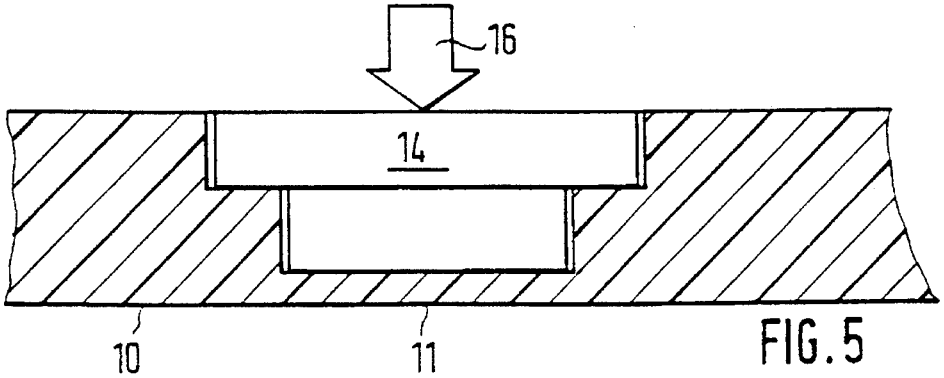
Figure 6:
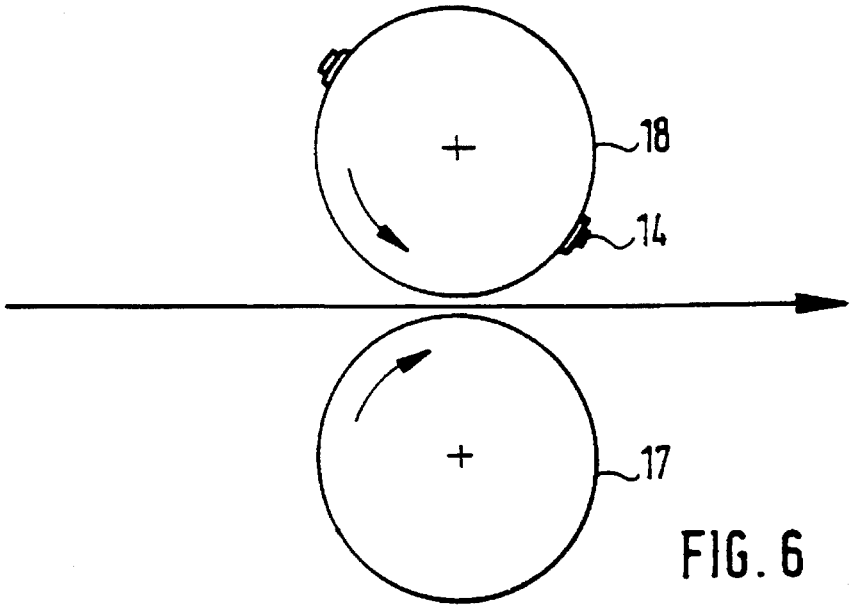
Figure 7:
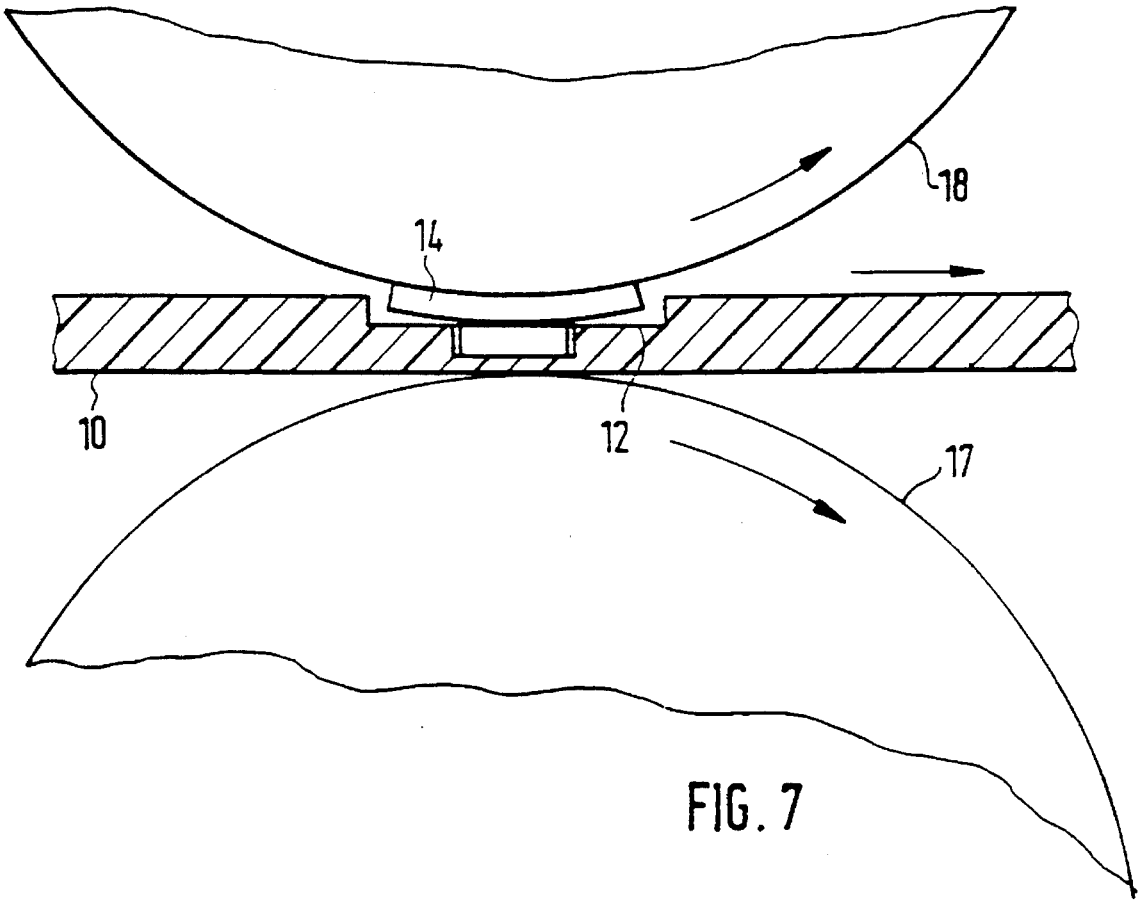

Further features and advantages of the invention can be found in the claims and the following description of an embodiment example described with reference to the drawing, in which:

FIG. 1 shows an identity card with a blind hole-shaped recess,

FIG. 2 shows a cross section through an identity card with a blind hole-shaped recess, FIG. 3 shows a cross section through an element adapted to the recess, FIG. 4 shows an element introduced into the blind hole-shaped recess, FIG. 5 shows the element shown in FIG. 3 during the printing operation, FIG. 6 shows a cross section through an apparatus for printing identity cards, FIG. 7 shows an enlarged detail from FIG. 6, FIG. 8 shows an enlarged detail from FIG. 6.

FIG. 1 shows an identity card 10 with a two-step blind hole-shaped recess 12 from the front. The blind hole-shaped recess serves to take up a chip module (not shown) later.

FIG. 2 shows an enlarged detail of section 2—2 of FIG. 1. Card body 10 shown can be produced for example in one operation by the injection molding technique, but other production methods are also conceivable (milling out the recess). Recess 12 has a membrane 11 that can also be concavely deformed at worst so that it does not lie on card surface 13 to be printed.

FIG. 3 shows an embodiment example for an element 14 adapted to the blind hole-shaped recess. Element 14 can be formed from a rigid material such that when it is introduced into blind hole-shaped recess 12 it fills it without a gap and in its entirety. The broken-line representation in FIG. 2 shows an element 14 that, when introduced into the recess, covers only the membrane. It is furthermore possible to produce elements 14 from a compressible material (e.g. cork or rubber).

FIG. 4 shows such a compressible element 14 in a two-step recess. At first no pressure is exerted on element 14. In this case the part of element 14 extending as far as membrane 11 covers membrane 11 only partly. A gap remains between the side walls of this part of element 14 and the side walls of the second step of the recess. The part of element 14 extending as far as membrane 11 has a height such that the height of element 14 in the unloaded state is slightly greater than the depth of the second step of blind hole-shaped recess 12. The result is that the remaining part of element 14 in the unloaded state does not lie on ledge 15 of the first step. Instead there is a gap between this part of element 14 and ledge 15. Furthermore the remaining part of element 14 is dimensioned such that in the unloaded state there is a gap between the side walls of this part and the side walls of the first step of two-step blind hole-shaped recess 12.

In FIG. 5 the card together with element 14 is loaded with a force oriented perpendicular to the card surface. This force 16 causes element 14 to be pressed into the two-step recess. Membrane 11 is first pressed against a base (not shown for the sake of clarity). Element 14 then spreads out nondirectionally in the blind hole-shaped recess in the plane perpendicular to force 16 until the recess is filled almost without a gap. When no more pressure acts on element 14 the deformation of element 14 caused by the pressure is undone. This permits element 14 to be removed from the two-step blind hole-shaped recess in such a way that the wallings of element 14 and recess 12 do not touch each other. Thus no forces occur during removal that could damage the identity card.

FIG. 6 shows a cross section through an apparatus for printing identity cards. The apparatus comprises two rotatably mounted cylinders 17 and 18. Cylinders 17 and 18 can be disposed e.g. vertically one above the other. The distance between cylinders 17 and 18 corresponds to the sum of the cylinder radii and the thickness of the object to be printed. The latter can thus be guided between cylinders 17 and 18. This guidance between cylinders 17 and 18 takes place perpendicular to the line connecting the two cylinder axes. Cylinder 17 serves as a print roll for applying the printed pattern to the identity card. The corresponding technology need not be exactly described here since it is sufficiently familiar to the expert. Second cylinder 18 functions as a back pressure roll for pressing the object to be printed against print roll 17. Elements 14 are glued onto back pressure roll 18 at periodic intervals so that they can be pressed into the blind hole-shaped recess of the identity card and fill the recess during the printing operation, as shown in FIG. 7. After the area of the card with the recess has passed rolls 17, 18, element 14 is removed from the recess again by the rotation of roll 17 and the further transport of the card in a straight line.

The apparatus for printing identity cards shown in FIGS. 6 and 7 has only an exemplary character; other embodiments are conceivable. For example rolls 17 and 18 need not necessarily have the same radius; a smaller radius of one of rolls 17 and 18 can be compensated by an accordingly higher angular velocity during rotation of the roll. Furthermore it is not necessary to dispose the printing plate and back pressure plate (containing element 14) on cylinders to produce printed identity cards with a blind hole-shaped recess 12. Other assemblies are also conceivable.

FIG. 8 shows an enlarged detail of an apparatus for printing identity cards with a blind hole-shaped recess. This embodiment is characterized in that element 14 is mounted movably in back pressure cylinder 18. In the following it will be described by way of example how the mobility of element 14 can be produced and what advantages result from this mobility.

Element 14 made of rubber is fixed on the face of a stepped pin 19. Stepped pin 19 is located in a sleeve 21 mounted in back pressure cylinder 18. Pin 19 is held in a predefined position by a compression spring 20 disposed in sleeve 21. Compression spring 20 presses the shoulder of pin 19 against a stop 24 screwed into sleeve 21 and reducing the inside diameter of sleeve 21. The position of stepped pin 19 in sleeve 21 can thus be exactly adjusted, or the projection of element 14 beyond the surface of the back pressure cylinder precisely fixed.

Adjusting ring 24 screwed into the inside thread of sleeve 21 can of course also be replaced by alternative adjusting means. For example corresponding shifting mechanisms engaging recesses of pin 19 (not shown) can also fix the pin against the force of a tension spring 20. Although pin 19 would likewise be adjustable in this case it would no longer be elastically retractable inwards in contrast to the embodiment shown in FIG. 8. Further variants are likewise possible depending on the required mode of functioning.

In the example shown in FIG. 8 pin 19 is freely movable within sleeve 21 in the radial direction toward the center of back pressure cylinder 18. When a force acts on element 14 which overcomes the force exerted by compression spring 20 pin 19 is thus pressed into the interior of sleeve 21. When the force on element 14 subsides pin 19 is pressed by compression spring 20 against stop 24 again so that element 14 resumes its original position.

Pin 19 can be additionally mounted in sleeve 21 secure from rotation by a nose engaging a longitudinal groove. For the sake of clarity these securing means are not included in FIG. 8.

The mobility of element 14 provides the advantage that both identity cards with blind hole-shaped recesses and those without such depressions can be printed without damage to back pressure cylinder 18 or without a need to change back pressure cylinder 18.

It should finally be mentioned that not only individual identity cards with recesses can be processed but also multicopy sheets with a multiplicity of such recesses. The inventive apparatus need in this case only be modified so that an accordingly positioned element engages each recess.

We claim:

1. A method of printing on cards having opposing parallel surfaces which are substantially planar, one of said opposing parallel surfaces including a blind hole-shaped recess with a membrane at a maximum depth of the recess, a printed pattern being transferred to the other of the opposing parallel surfaces by means of a printing plate which presses the card against a surface serving as a support during the printing operation, comprising the steps of:

introducing an element into the recess which at least partially fills the recess; and holding the membrane in the printing plane with said element to stabilize said membrane against the pressure of the printing plate towards the support surface.

2. The method according to claim 1, wherein said element is fasted to the surface serving as support and said step of introducing the element comprises introducing said element only during the printing operation.

3. An apparatus for printing on cards having opposing parallel surfaces which are substantially planar, one of said opposing parallel surfaces including a blind hole-shaped recess with a membrane at a maximum depth of the recess, a printed pattern being transferred to the other of the opposing parallel surfaces, comprising:

a support surface for supporting each card during the printing operation;

a printing plate for pressing said each card against the support surface; and an element on the support surface for being introduced into the recess and stabilizing the membrane against the pressure of the printing plate towards the support surface during the printing operation.

4. The apparatus according to claim 3, wherein said element is fastened to the support surface.

5. The apparatus according to claim 4, wherein said element is fastened to the support surface with glue.

6. The apparatus according to claim 3, wherein said element is made of a compressible material.

7. The apparatus according to claim 3, wherein the support surface is a back pressure roll having a plurality of elements formed on its circumference.

8. The apparatus according to claim 3, wherein said element is sized to correspond to at least the surface of the membrane in the recess.

9. The apparatus according to claim 3, wherein said element is sized to correspond to the shape of the recess.

10. The apparatus according to claim 6, wherein said element is sized to have a height which is greater than the depth of said recess and said compressible material adapts to the recess by compression during the printing operation.

11. An apparatus for printing on cards having opposing parallel surfaces which are substantially planar, one of said opposing parallel surfaces including a blind hole-shaped recess with a membrane at a maximum depth of the recess, a printed pattern being transferred to the other of the opposing parallel surfaces, comprising:

a support surface for supporting each card during the printing operation;

a printing plate for pressing said each card against the support surface; and an element movably disposed in said support surface for being introduced into the recess and stabilizing the membrane against the pressure of the printing plate towards the support surface during the printing operation.

12. The apparatus according to claim 11, further including a recess in said support surface, and a pin fastened to the element and adapted to reciprocate in the recess in said support surface.

13. The apparatus according to claim 12, wherein the recess in said support surface includes a stop, said apparatus further including a compression spring adapted to press said pin against said stop such that the element protrudes out of the recess in said support surface in a predefined form.

14. The apparatus according to claim 13, wherein a position of said stop in the recess in said support surface is variable.

* * * * *